US006868586B1

(12) United States Patent
Hall

(10) Patent No.: US 6,868,586 B1
(45) Date of Patent: Mar. 22, 2005

(54) FASTENING MEANS FOR A BUNGIE CORD

(75) Inventor: Christopher A. Hall, Kent, WA (US)

(73) Assignee: NZ Manufacturing, Inc., Tallmadge, OH (US)

( * ) Notice: Subject to any disclaimer, the term of this patent is extended or adjusted under 35 U.S.C. 154(b) by 0 days.

(21) Appl. No.: 10/641,529

(22) Filed: Aug. 14, 2003

Related U.S. Application Data

(60) Provisional application No. 60/403,843, filed on Aug. 14, 2002.

(51) Int. Cl.[7] ..... A44B 21/00

(52) U.S. Cl. ..... 24/115 A; 24/265 H; 24/265 R; 24/300

(58) Field of Search ..... 24/115 A, 300, 24/298, 265 H, 302; 248/499; 482/121, 124, 127, 129, 131

(56) References Cited

U.S. PATENT DOCUMENTS

| | | | | | |
|---|---|---|---|---|---|
| 3,328,064 | A | * | 6/1967 | Simon | 24/298 |
| 4,955,608 | A | * | 9/1990 | Dougherty et al. | 482/124 |
| 5,205,803 | A | * | 4/1993 | Zemitis | 482/124 |
| 5,229,178 | A | * | 7/1993 | Zemitis | 24/300 |
| 5,317,788 | A | * | 6/1994 | Esposito et al. | 24/300 |
| 5,383,259 | A | * | 1/1995 | McIntire | 24/300 |
| 5,638,584 | A | * | 6/1997 | De Anfrasio | 24/265 H |
| 6,202,263 | B1 | * | 3/2001 | Harker | 24/300 |

* cited by examiner

*Primary Examiner*—Robert J. Sandy
(74) *Attorney, Agent, or Firm*—Brouse McDowell; Roger D. Emerson; Daniel A. Thomson

(57) ABSTRACT

A new and improved method and apparatus for securing a stretchable cord to be used in association with exercise equipment is disclosed herein.

9 Claims, 5 Drawing Sheets

FASTENING MEANS FOR A BUNGIE CORD

This application priority to provisional patent application, Ser. No. 60/403,843, entitled FASTENING MEANS FOR A BUNGIE CORD, filed Aug. 14, 2002.

I. BACKGROUND OF THE INVENTION

A. Field of Invention

This invention pertains to the art of methods and apparatuses for an improved means for the attachment for bungie cords.

B. Description of the Related Art

In the art of swim training, physical rehabilitation, sports training and general fitness, resistive exercise products are often utilized in exercise and training programs. Often, a cord such as a bungie cord, provides part of the resistance for the exercise product. Weights or other stationary objects may provide increased resistance. In order to attach an appropriate weight, or other training device to the cord, an attachment is utilized. Further, it may also be desirable for the user to have a belt worn around their waist such that they can have the cord secured to the belt. As such, fastening means of sufficient strength must be utilized to secure an attachment to the cord. While current devices suit their intended purpose, problems still exist. Current fastening means do not provide for secure and easy fastening of the attachments to the user. The present invention provides for methods and apparatuses that provide for easy and secure fastening means of an attachment.

Over time, conventional bands and tubes break. This is for several reasons. First, the bands and tubes stretch repeatedly over time, and they experience fatigue which eventually results in failure. Further, the bands and tubes may be drug along the ground, which causes the bands and tubes to fray.

II. SUMMARY OF THE INVENTION

According to one aspect of the present invention, a new and improved attachment for bungie cords is provided which comprises a plurality of steel rods wrapped around a cord.

In accordance with another aspect of the present invention, a substantially elastic cord includes a first end, a second end, a first and second body portion, the first and second body portions being in such relationship to each other to form a loop, and at least one fastening means, the fastening means circumnavigating both the first and second body portions, such that the body portions are in substantial contact with each other.

In accordance with another aspect of the present invention, the at least one fastening means is a metallic rod.

In accordance with another aspect of the present invention, the rod has a first and a second end, the rod being wrapped in such a way that the ends overlap each other.

In accordance with another aspect of the present invention, the at least one fastening means is multiple fastening means, the fastening means be positioned approximately an equal distance from each other.

In accordance with another aspect of the present invention, the at least one fastening means is a metallic band.

In accordance with another aspect of the present invention, the cord further includes a foam cover, the foam cover substantially covering the fastening means and an attachment, the attachment being positioned within the loop.

In accordance with another aspect of the present invention, the fastening means can withstand forces of between approximately 0 lbs. to approximately 150 lbs.

In accordance with another aspect of the present invention, the band can withstand pressures of between approximately 0 lbs. to approximately 486 lbs.

In accordance with another aspect of the present invention, a method for securing a cord, the cord having first and second ends and first and second body portions, includes the steps of positioning the first body portion adjacent to the second body portion in order to form a loop and attaching at least one fastening means around the body portions.

In accordance with another aspect of the present invention, the method further includes placing a cover over the fastening means.

In accordance with another aspect of the present invention, before positioning the first body portion adjacent to the second body portion in order to form a loop, the method includes the step of inserting the cord through an attachment.

In accordance with another aspect of the present invention, attaching at least one fastening means around the body portions further includes the step of attaching multiple metallic rods around the body portions, the rods being spaced at substantially equal distances from each other.

In accordance with another aspect of the present invention, attaching multiple metallic rods around the body portions, the rods being spaced at substantially equal distances from each other further includes the step of attaching multiple metallic rods around the body portions, the rods being spaced at substantially equal distances from each other, rods being attached with a pressurized air gun.

In accordance with another aspect of the present invention, the method further includes the step of attaching the attachment to an associated exercise device.

One advantage of the present invention is the ease in utilizing the invention.

Another advantage of the present invention is that it is more economically advantageous to manufacture than other apparatuses and methods known in the art.

Another advantage of the present invention is that the securing means may be covered with a foam cover for comfort to the user.

Another advantage of the present invention is the strength of the bungie cord over conventional rubber bands and rubber tubing.

Still other benefits and advantages of the invention will become apparent to those skilled in the art to which it pertains upon a reading and understanding of the following detailed specification.

III. BRIEF DESCRIPTION OF THE DRAWINGS

The invention may take physical form in certain parts and arrangement of parts, at least one embodiment of which will be described in detail in this specification and illustrated in the accompanying drawings which form a part hereof and wherein.

IV. DESCRIPTION OF THE INVENTION

Figure 1:
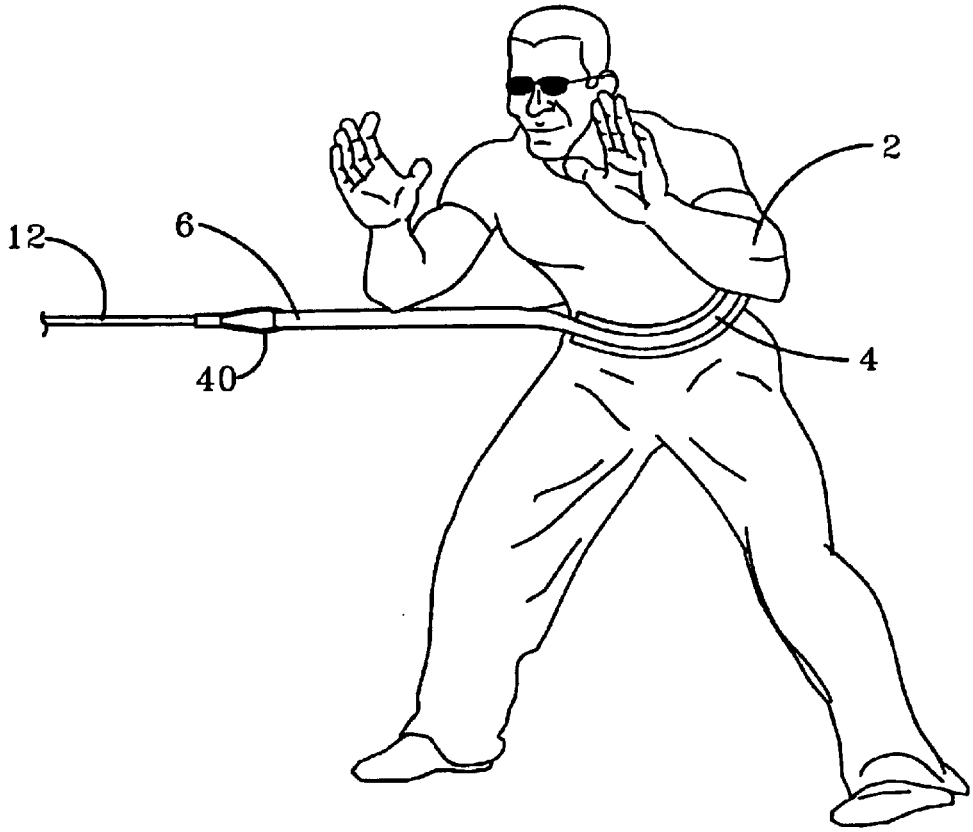
FIG. 1 is a perspective view of a user utilizing the present invention.

Referring now to the drawings wherein the showings are for purposes of illustrating at least one embodiment of the invention only and not for purposes of limiting the same, FIGS. 1–5 show the present invention. As previously stated, people involved in swim training, physical rehabilitation, sports training and general fitness, often utilize resistive exercise products in their training regime. A stretchable cord, such as a bungee cord, provides part of the resistance for the exercise product. Weights or other stationary objects may provide increased resistance. Because high tensile forces are being placed on the cord, appropriate fastening means are required to maintain the cord in the appropriate position with respect to an attachment 40. With specific reference to FIG. 1, an athlete 2 is shown utilizing the present invention. A belt 4 may be worn around the athlete's waist. The belt has a ring 6 at its end to receive the attachment 40, which is described in more detail below. As shown in FIG. 1, the athlete 2 is able to strengthen targeted muscle groups by placing tension on the stretchable cord with his body. Due to the elastic and resistive nature of the stretchable cord, the cord pulls the athlete 2 towards the attachment, and since the athlete 2 is pulling his body in the opposite direction, muscles are strengthened.

With reference to FIGS. 2–5, an apparatus 10 is utilized to secure various attachments 40 to a cord 12. The cord 12 may be a bungee cord or any other cord utilized in the fitness and rehabilitation industry. As such, bungee cords or other similar cords chosen with sound engineering judgment may be utilized with the present invention, such as, but not limited to, rope or rubber tubing.

Figure 2:
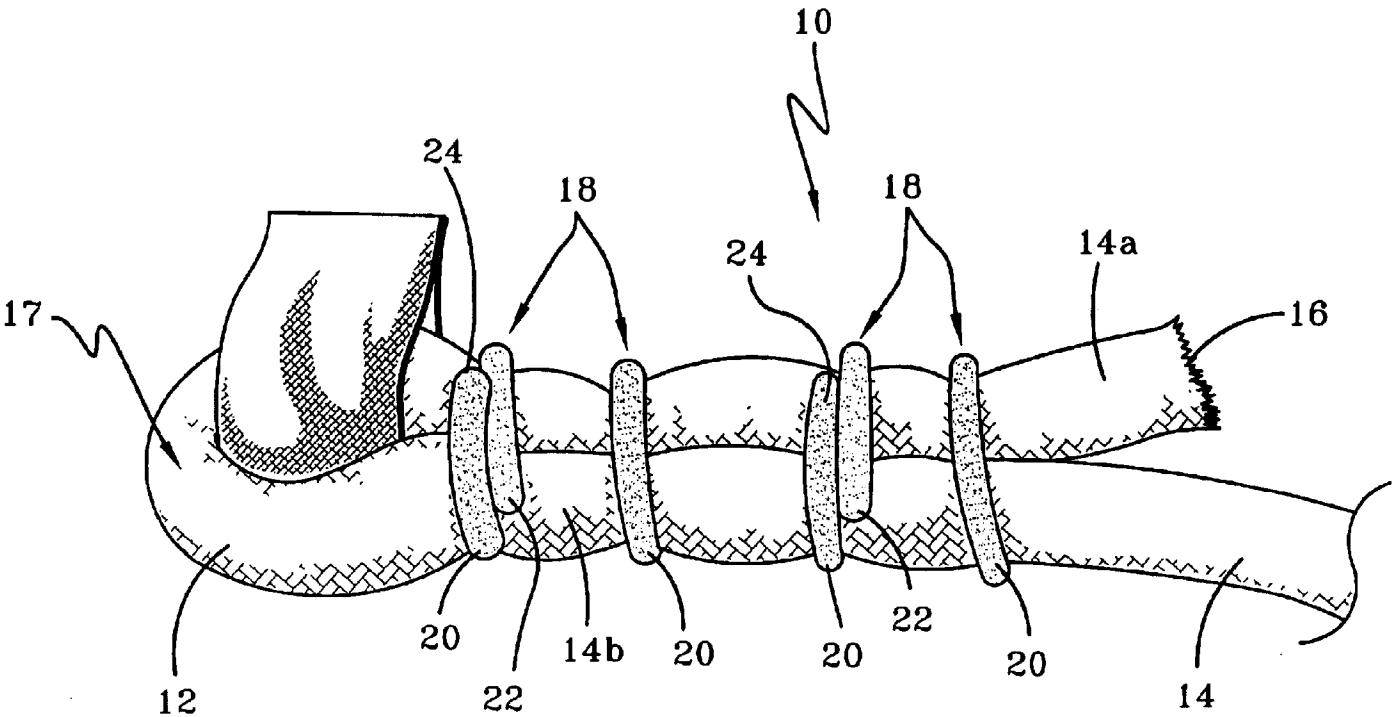
FIG. 2 is a perspective view of the present invention showing the use of steel rods tightly secured about the cord.
Figure 3:
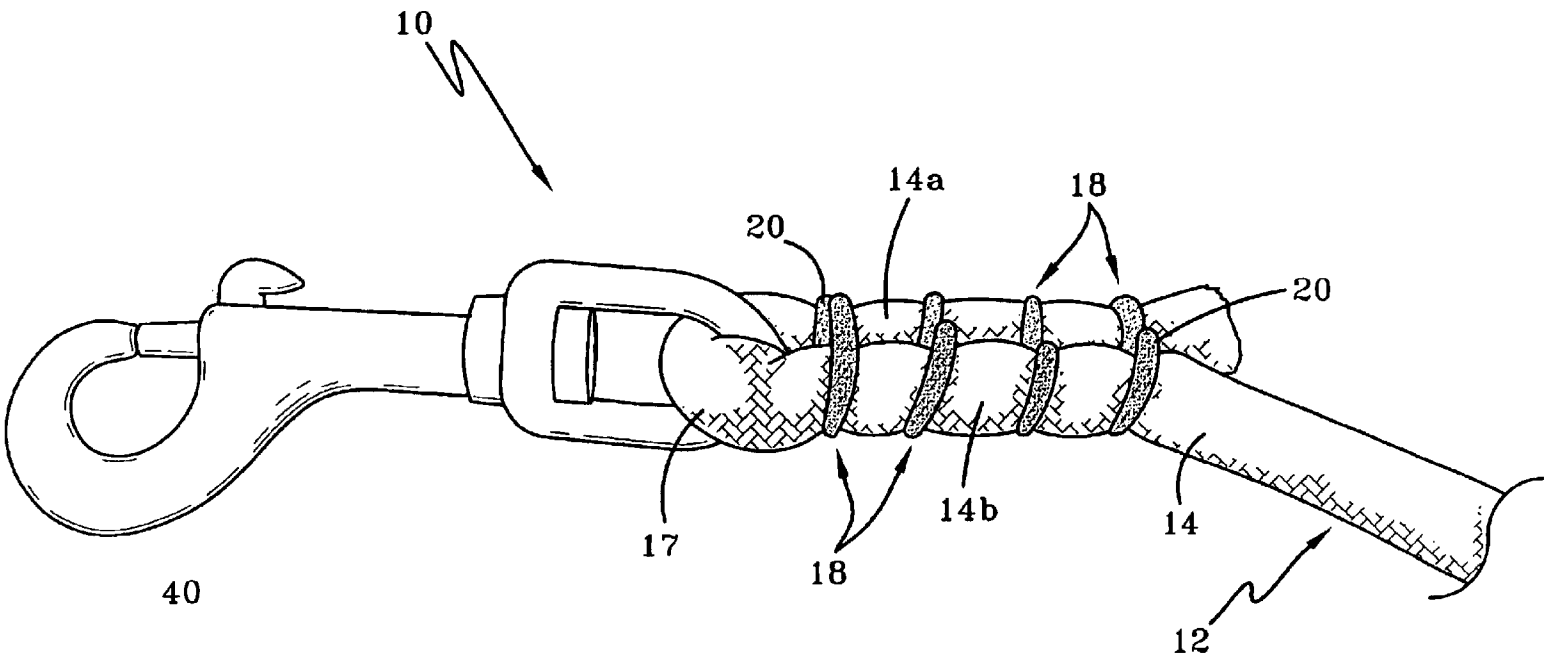
FIG. 3 is a perspective view of the present invention showing an attachment secured to the cord.
Figure 4:
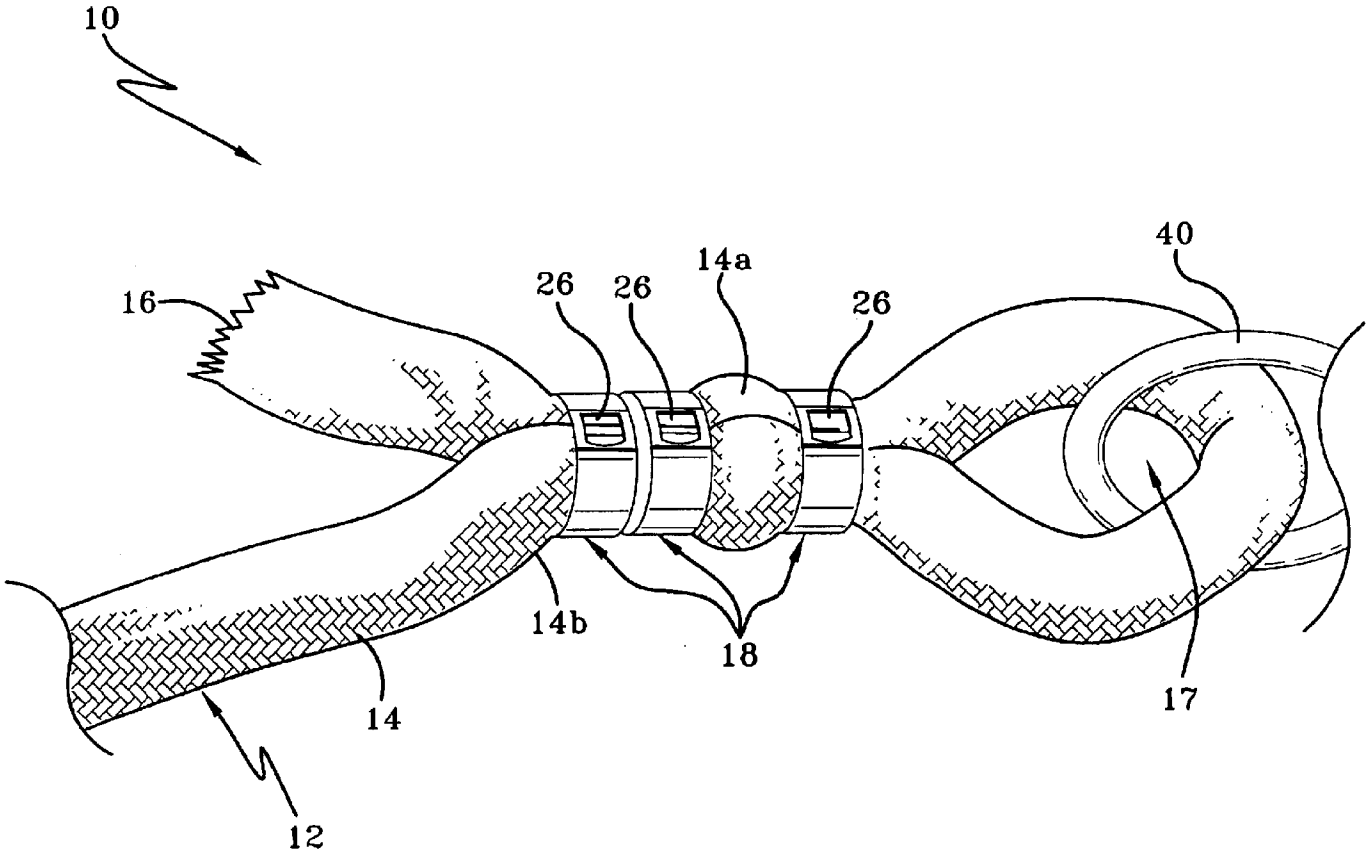
FIG. 4 is another embodiment of the present invention showing the securing means in the form of steel bands; and, FIG. 5 is the perspective view of the present invention showing a cover positioned over the securing means.

The cord 12 has a body 14 with a first portion 14*a*, a second portion 14*b*, and an end 16. When the first portion 14*a* is positioned adjacent to the second portion 14*b*, a loop 17 is formed. In order to fasten the first portion 14*a* to the second portion 14*b*, fastening means 18 is utilized. More specifically, the fastening means 18 may be rods 20 having a first end 22 and a second end 24 that are tightly wrapped around the cord by means of an air gun (not shown) or manually operated compression tool (not shown). As shown in FIGS. 2–3, the rods are commonly referred to as "hog rings." In another embodiment, as shown in FIG. 4, the fastening means 18 may be bands 26. Preferably, four or five rod bars 20 or bands 26 are wrapped about the first and second portions 14*a*, 14*b* of the cord 12. As shown in FIGS. 2 and 3, the first end 22 and the second end 24 of the rods 20 do not align when they are fastened to the cord 12. Although it is contemplated that the first and second ends 22, 24 could align, a more secure attachment of the first portion 14*a* to the second portion 14*b* is achieved if the ends 22, 24 do not align. It is even more preferable that the rods 20 or bands 26 be positioned approximately an equal distance from each other. With this positioning, the fastening means 18 provides the strongest connection of the first portion 14*a* to the second portion 14*b* of the cord 12. It is contemplated that the rods 20 and bands 26 can withstand forces of approximately 0–150 lbs. and 0–486 lbs., respectively, and still maintain the connection of the first portion 14*a* to the second portion 14*b*. These ranges, of course, are dependent on the cord size and the size of the rods 20 and bands 26. Further, the rods 20 and bands 26 are preferably made of steel; however, any other material chosen in accordance with sound engineering judgment may be utilized, including but not limited to plastic cords, tape, heat-shrunk tubing or plastic tie downs.

It is also contemplated to be within the scope of the present invention to utilize string or glue as the fastening means 18 to secure the first portion 14*a* to the second portion 14*b* of the cord 12.

Figure 5:
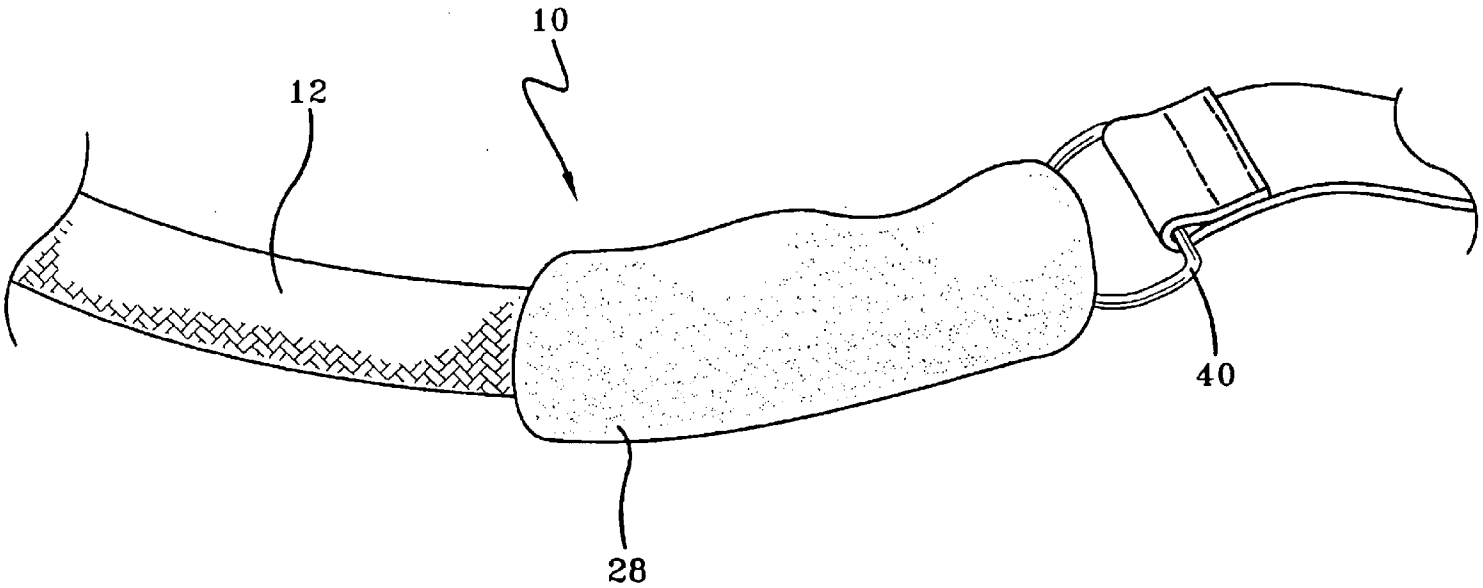

As shown in FIG. 5, a cover 28 may be placed over the fastening means 18 for the comfort of the user. The cover may be any material chosen with sound engineering judgment, but is preferably a foam-like material that provides cushioning between the fastening means 18 and the user. The foam-like material may be nitrile hand foam, acrylonitrile/polyvinyl chloride or neoprene/EPT.

As shown in FIGS. 3–5, an attachment 40 is positioned within the loop 17 of the cord 12. As shown in FIGS. 3–5, the attachment 40 may take the form of a ring. Any attachment of any geometric shape may be utilized by the user that is chosen with sound engineering judgment.

In order to utilize the present invention, a cord 12 is provided along with the plurality of rods 20 and/or bands 26 as previously described. The attachment 40 may be slipped over the cord 12 at this time. The first portion 14*a* of the body is positioned adjacent to the second portion 14*b* of the body 14 to form a loop 17. Utilizing an air gun or similar means, the rods 20 are fastened to the body 14 of the cord 12 with the air gun. It is contemplated that an air gun capable of providing sufficient compressive force to the hog rings be utilized. The air gun is driven by compressed air which may be at a minimum of 95 psi. Compressive forces created by the jaws of the gun vary with the model of air gun utilized. Because this compressive force can vary from manufacturer to manufacturer and air guns are known in the art, the air gun will not be further described herein. Once the fastening means 18 are attached to the cord 12, the attachment 40 may then be attached to a weight or other training device for the user. Once the fastening means 18 is secured to the cord 12, the cover 28 may be positioned over the fastening means 18 for further comfort to the user.

An athlete 2, or other user who wishes to take benefit of the present invention, obtains a cord 12, which has the fastening means 18 already secured thereto. The athlete then positions an auxiliary apparatus, such as a belt, on his or her body. The attachment 40 is secured to the auxiliary apparatus. The athlete 2 can then strengthen muscle groups by placing his or her body in tension with respect to the cord 12. Further, if the athlete 2 desires to obtain better balance by holding on to the cord 12 with his or her hands, he or she may position their hands on the cover 28, which provides for a more comfortable grip.

At least one embodiment been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

What is claimed is:

1. A substantially elastic cord comprising:

a first and second body portion, the first and second body portions being in such relationship to each other to form a loop;

at least one fastening means, the fastening means circumnavigating both the first and second body portions, such that the body portions are in substantial contact with each other;

a foam cover, the foam cover substantially covering the fastening means; and, an attachment, the attachment being positioned within the loop.

2. The cord of claim 1, wherein the at least one fastening means is a metallic rod.

3. The cord of claim 2, wherein the rod has a first and a second end, the rod being wrapped in such a way that the ends overlap each other.

4. The cord of claim 3, wherein the at least one fastening means is multiple fastening means, the fastening means be positioned approximately an equal distance from each other.

5. The cord of claim 1, wherein the at least one fastening means is a metallic band.

6. The cord of claim 4, wherein the fastening means can withstand forces of between approximately 0 lbs. to approximately 150 lbs.

7. The cord of claim 5, wherein the band can withstand pressures of between approximately 0 lbs. to approximately 486 lbs.

8. A method for securing a cord, the cord having first and second body portions, the method comprising the steps of:

positioning the first body portion adjacent to the second body portion in order to form a loop;

attaching at least one fastening means around the body portions;

placing a cover over the fastening means;

inserting the cord through an attachment; and, attaching multiple metallic rods around the body portions, the rods being spaced at substantially equal distances from each other, the rods being attached by pressurized means.

9. The method of claim 8, wherein the method further comprises the step of:

attaching the attachment to an associated exercise device.

* * * * *